US005480036A

United States Patent [19]

Opar

[11] Patent Number: 5,480,036

[45] Date of Patent: Jan. 2, 1996

[54] GREETING CARD DISPLAY APPARATUS OR THE LIKE

[76] Inventor: Mark A. Opar, 1100 Lakeview Dr., Bridgeville, Pa. 15017

[21] Appl. No.: 257,003

[22] Filed: Jun. 8, 1994

[51] Int. Cl.[6] ..... A47F 7/00

[52] U.S. Cl. ..... 211/45; 211/205; 211/163; 40/124

[58] Field of Search ..... 211/171, 45, 47, 211/196, 205, 163; 248/158, 159, 415; 40/124, 124.2, 124.4

[56] References Cited

U.S. PATENT DOCUMENTS

| | | | |
|---|---|---|---|
| 612,718 | 10/1898 | Finan | 211/171 |
| 1,751,505 | 3/1930 | Borland | 211/163 |
| 2,542,137 | 2/1951 | Hanson | 211/196 X |
| 3,051,320 | 8/1962 | Barnett | 211/196 |
| 3,263,355 | 8/1970 | March | 40/124 |
| 3,524,274 | 8/1970 | Glassburn | 40/124.4 |
| 3,524,275 | 8/1970 | Korth | 40/124.4 |
| 3,599,360 | 8/1971 | Lappo | 40/124.4 |
| 3,789,526 | 2/1974 | Lavinson | 40/124 |
| 4,767,088 | 8/1988 | Fielder et al. | 211/205 X |
| 4,852,280 | 8/1989 | Beattie | 40/124 |
| 5,088,216 | 2/1992 | Wasilico | 40/124.4 |
| 5,335,796 | 8/1994 | Sanford et al. | 211/45 |

FOREIGN PATENT DOCUMENTS 616880 10/1959 Italy .

*Primary Examiner*—Robert W. Gibson, Jr.
*Attorney, Agent, or Firm*—J. Stewart Brams

[57] ABSTRACT

A greeting card display apparatus including an upstanding card retaining assembly with concealed slot means for receiving a plurality of endless loop elastic cords in a manner that the elastic cords extend in tension along the periphery of the upstanding assembly to retain greeting cards with respect to the upstanding assembly.

18 Claims, 2 Drawing Sheets

GREETING CARD DISPLAY APPARATUS OR THE LIKE

BACKGROUND OF THE INVENTION

In the art of greeting card displays there are known a variety of display structures for retaining a plurality of greeting cards or the like in a manner that the cards are distributed about an outer peripheral portion of a generally cylindrical body. For example, the following U.S. patents disclose structure of pertinence to such apparatus: U.S. Pat. Nos. 4,852,280, 3,789,526, 5,088,216 and 3,524,274. Other prior art patents include U.S. Pat. Nos. 3,524,725, which discloses a greeting card display rack for retaining greeting cards by means of upstanding pegs or pins against which an elongated spring is biased, and U.S. Pat. No. 3,263,355, which discloses a card holding device including a frame with vertically spaced plate members having peripheral slots to receive and retain greeting cards. Another, similar greeting card display characterized as a display tree is disclosed by U.S. Pat. No. 3,599,360. Finally, Italian patent 616880 discloses a display device with cords extending along a curved surface to secure items against the curved surface.

BRIEF SUMMARY OF THE INVENTION

The present invention contemplates an improved greeting card display apparatus or the like having the advantages of simplified structure and assembly that is particularly well suited to the use of endless loop elastic bands to retain greeting cards with respect thereto whereas the prior art has relied chiefly on continuous lengths of inextensible cord for this purpose. Further, in accordance with the present invention the openings for securing the greeting card retaining cords with respect to the display apparatus are concealed by other structural members. Other features of the invention include means to accommodate interchangeable thematic motifs mounted on the greeting card retention assembly, and a novel structural configuration for retaining elongated elastic cords with respect to a central body portion of a greeting card retention assembly.

The invention is thus of improved and simplified structure, inexpensive of manufacture and very simple to assemble, among other advantages.

It is therefore one object of the invention to provide a novel and improved greeting card display apparatus.

A further object of the invention is to provide an improved greeting card display apparatus including or adapted to accommodate a plurality of endless loop elastic cords in a greeting card retention assembly for retaining greeting cards with respect to the assembly.

A further object of the invention is to provide such a greeting card display apparatus wherein the means for retaining endless loop elastic cords are concealed by structural elements of the greeting card retaining assembly.

These and other objects and further advantages of the invention will be more readily appreciated upon consideration of the following detailed description and the accompanying drawings, in which.

Figure 1:
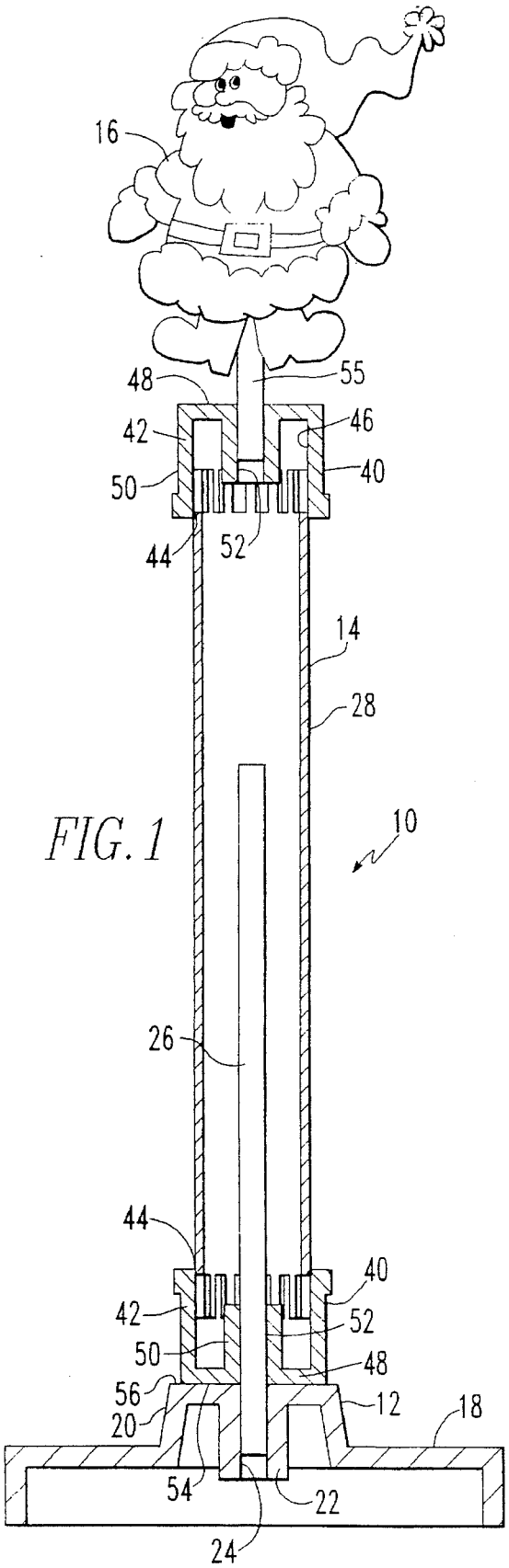
FIG. 1 is a sectioned side elevation of a greeting card display apparatus including features of the instant invention.
Figure 3:
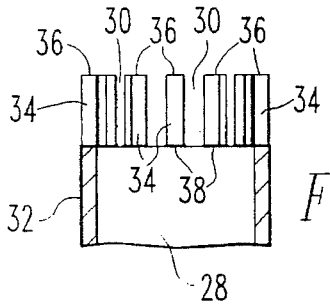
FIG. 3 is an enlarged, fragmentary portion of FIG. 2 showing the mounting of elastic cords.
Figure 2:
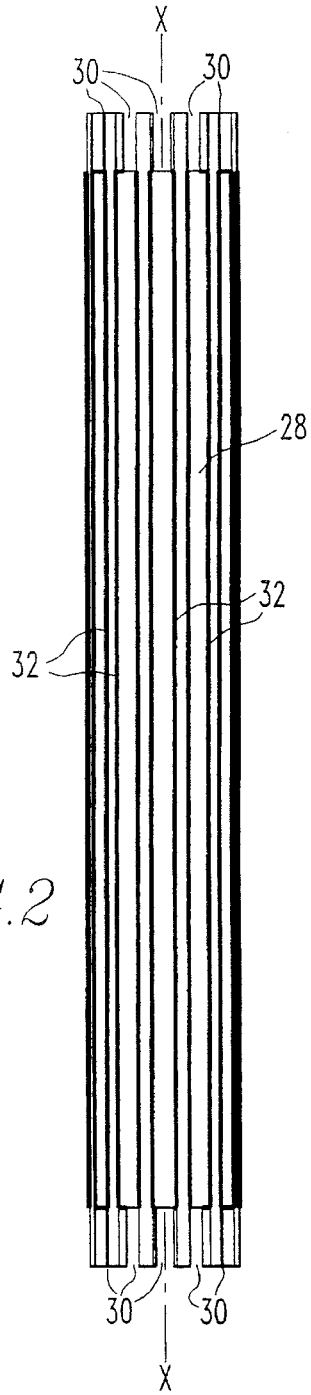
FIG. 2 is a side elevation of an elastic cord retaining member of FIG. 1.

Referring to FIGS. 1 to 3, I have disclosed one embodiment of my novel greeting card display apparatus which includes some structural features of my preferred embodiment; however, the embodiment of FIGS. 1 to 3 also includes certain structural features such as a rotary engagement of a cylindrical card retaining assembly on a base, and identical end caps for the assembly, which are not part of the preferred embodiment of my invention. My presently preferred best mode embodiment is disclosed hereinbelow with reference to FIGS. 4 and 5.

There is generally at 10 in FIG. 1 a greeting card display apparatus comprised of an assembly of structural elements, all preferably of such suitable material as formed (e.g. molded) plastic.

Greeting card display assembly 10 includes a base assembly 12 which receives a greeting card retaining assembly 14 thereon. A thematic motif such as a seasonal figurine 16 is received atop the card retaining assembly 14.

Base assembly 12 comprises a generally stepped cylindrical base member 18 having an upstanding central portion 20 which includes a downwardly projecting central sleeve portion 22 having a vertical opening 24 formed therein.

An elongated, upstanding rod 26, preferably of cylindrical form, has a lower end thereof received into opening 24 for retention of the rod 26 in upstanding relation with respect to base member 18. In order to so retain rod 26, the cross sectional configuration and/or dimensions of opening 24 may be formed to provide an interference fit with the lower end of rod 26. For example, opening 24 may taper downwardly at a slight taper angle sufficient to provide a friction fit of increasing frictional force with the lower end of rod 26 as the rod is forced downwardly into opening 24.

Card retaining assembly 14 includes an elongated, open-ended cylindrical tube member 28 having a plurality of openings in the form of open-ended slots 30 extending axially from the opposed ends thereof for a suitable distance to permit use of the slots 30 to capture and retain elastic cord elements in a manner to be described hereinbelow.

The slots 30 at each end of tube 28 are distributed circumferentially about the respective ends of tube 28 at a uniform spacing to provide uniform spacing of the elastic cord elements to be retained thereby. Further, the slots 30 at one end of tube 28 are aligned axially with corresponding slots 30 at the opposed end of tube 28 so that elastic cord elements may be mounted to extend along the outer periphery of tube 28 in exact alignment with the axis of tube 28, that is without being skewed or offset with respect to the axis of the tube 28. FIG. 2 shows such an arrangement of elastic cords 32 all arranged in mutually parallel relation and all extending in alignment with axis X—X of tube 28.

FIG. 3 shows an enlarged, fragmentary portion of tube 28 with several of the slots 30 receiving individual elastic cords 32. The spaced slots 30 form a corresponding plurality of intervening legs 34 to receive the cords 32. The cords 32, endless loop rubber bands for example, thus are received over the upper ends 36 of legs 34 to pass behind the legs 34 and through the slots 30 on either side of each leg 34, as shown at 38 in FIG. 3. The two runs of each cord 32 pass along the length of the tube 28 and are similarly retained by legs 34 and corresponding slots 30 adjacent the opposed end of tube 28 as shown in FIG. 2.

Since the invention accommodates use of endless loop elastic cord as indicated, the requirement to use a single elongated strand of cord as called for by several prior art structures is avoided. By passing each cord 32 over one leg 34 at one end of tube 28, and over the corresponding, aligned leg 34 at the opposed end of tube 28, the two strands of cord provided thereby which extend along the length of tube 28 are automatically axially aligned with the axis of tube 28. There is no need to provide an offset between the sets of slots and intervening legs at one end of tube 28 with respect to those at the other end as would be required if a single length of cord were used. Further, with the use of endless loop cords 32 as shown in FIG. 3, essentially the entire inner space of tube 28 is open whereby the assembly of cords 32 with tube 28 does not interfere with other elements such as the rod 26 which projects within the interior of tube 28.

In order to securely retain the cords 32 with respect to tube 28, and additionally to conceal the cord retention structure comprised of slots 30 and legs 34, end cap members 40 are received on the opposed open ends of tube 28, respectively. The end caps 40 may be essentially identical in structure, each comprising a generally cylindrical, axially elongated skirt portion 42 defining a tubular portion having an open end 44, which is the opening into a pocket having an inner periphery 46. A corresponding end of tube 28 is received via opening 44 into the pocket and is retained therein by engagement with inner periphery 46. More specifically, the fit of tube 28 within a respective end cap is preferably an interference or friction fit provided by, for example, a slight taper of the inner periphery 46 to smaller diametrical dimensions at locations away from open end 44. Alternatively, the axial length of skirt portion 42 may be sufficient to permit each end cap 40 to be received onto a corresponding axial end of tube 28 for sufficient distance to overlap a portion of the cords 32 extending along the outer periphery of tube 28. In this instance, the inner periphery 46 may be suitably dimensioned, with respect to the exterior periphery of tube 28, such that when tube 28 is inserted axially into the inner periphery 46 of an end cap 40, the interference of cords 32 between tube 28 and the inner periphery 46 secures and retains the end cap 40 on the axial end of tube 28.

In any event, skirt 42 and the inner periphery 46 of each end cap 40 preferably are to be of an axial length sufficient to essentially entirely conceal slots 30 within the end cap 40.

Each end cap 40 also includes a transverse wall portion 48 at the axial end thereof opposed to the opening 44, and a central, elongated sleeve portion 50 extending coaxially with respect to sleeve portion 42. A coaxial through opening 52 extends within each central sleeve portion 50.

For the upper end cap 40, opening 52 receives a mounting element such as as a post portion 55 of the seasonal figurine 16 in friction or interference fit by any suitable means such as described hereinabove. This permits selective removal of the figurine 16 and replacement thereof with any suitable variation to commemorate a season, holiday or occasion of note.

For the end cap 40 at the opposed end of tube 28, opening 52 receives rod 26 in slidable relation to support and retain assembly 14 with respect to base assembly 12. The assembly 14 thus may be rotatable with respect to base assembly 12, whereby a friction or interference fit between rod 26 and opening 52 of the lower end cap 40 would not be appropriate. An outer transverse surface portion 54 of transverse wall 48 bears upon a corresponding upwardly facing surface 56 to provide a thrust bearing interface for vertical support of assembly 14 and figurine 16 with respect to base assembly 12.

Figure 4:
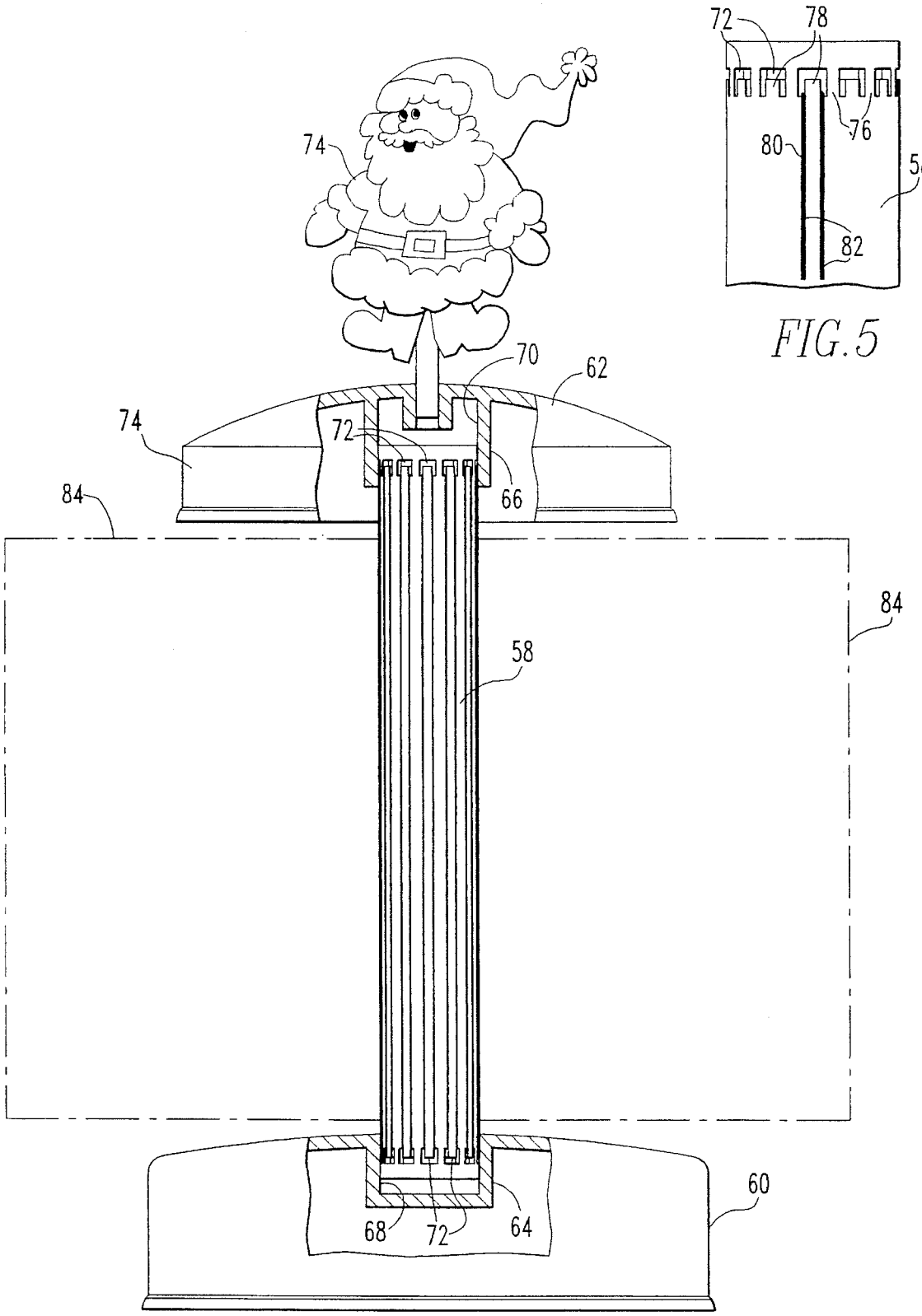
FIG. 4 is a partially sectioned side elevation of a greeting card display apparatus according to a presently preferred embodiment of the invention.
Figure 5:
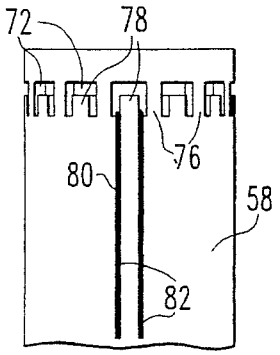
FIG. 5 is a fragmentary view similar to FIG. 3 showing a different elastic cord retention structure.

My presently preferred embodiment of the invention, as shown in FIGS. 4 and 5, is similar in many respects to that described hereinabove, but no rotary base is provided and the end caps are not identical. In addition, the configuration of openings to receive and retain elastic cords is different from those described hereinabove.

Referring to FIG. 4, there is shown an elongated, hollow, upstanding cylindrical tube 58 in assembly with a base member 60 and a cap member 62. Base 60 and cap 62 include axially projecting cylindrical skirt portions 64 and 66, respectively, having open interiors 68 and 70, respectively, to receive the opposed ends of tube 58 in essentially the same manner as described hereinabove with reference to the tube 28 and end caps 40 of FIG. 1.

Also completely in accordance with the above description with reference to FIG. 1, cap 62 and base 60 receive the ends of tube 58 in a manner that the respective skirt portions 64 and 66 overlap and conceal plural openings 72 formed in the opposed ends of tube 58. A decorative figurine 74 is retained atop cap member 62, also essentially in the manner as described hereinabove with reference to FIG. 1.

As will be appreciated, the preferred embodiment of FIG. 4 incorporates no rotary interconnection between a greeting card retention assembly and base 60, although the assembly could incorporate such a rotary interface such as in the manner of the embodiment described hereinabove with reference to FIG. 1, or otherwise. Further, cap 62 includes an outer, generally cylindrical depending skirt portion 74 located radially outwardly from skirt portion 66. The skirt 74 projects downwardly beyond the axial extent of skirt portion 66 to thereby conceal the upper end openings 72 of tube 58 even if skirt 66 does not fully overlap the corresponding openings 72.

Referring to FIG. 5, the preferred openings 72 differ structurally from those described above with reference to FIGS. 1 through 3 in that they are formed as apertures rather than axially extending, open-ended slots. Thus, each opening 72 is an aperture separated from the immediately adjacent apertures 72 by intervening portions 76. Each aperture 72 includes an axially projecting tongue portion 78 for receiving and retaining one end of an endless loop elastic cord 80 as shown in FIG. 5. The elastic cord 80 thus is received over respective tongue portions 78 at opposed ends of tube 58 in essentially the same manner as the elastic cords 32 are installed on tube 28 as described hereinabove with reference to FIGS. 1 to 3. Accordingly, each elastic cord 80 provides a pair of elastic cord runs 82 extending axially of tube 58 in alignment with the axis thereof as described hereinabove with reference to FIG. 2.

It will be appreciated that for either the slots 30 or the apertures 72, installation and retention of the elastic cords is the same. Thus, the described invention calls for a plurality of endless loops of elastic cord rather than a continuous length of inextensible cord having free ends which must be secured. If a continuous length of cord, whether elastic or not, becomes worn or frayed, or if it should break, the entire system of cord windings must be replaced. In the above-described display apparatus, if an elastic cord breaks or otherwise requires replacement, only that single endless loop cord need be replaced while the others may be retained. The endless loop elastic cords are installed individually for individual use and replacement as needed.

Further, an inextensible endless loop cord cannot be used with the above-described structure as the cord must be stretched axially of the tube 28 or 58 in order to pass over the ends of the respective legs 34 or tongues 78. With an endless loop cord thus installed on tube 28 or 58, the cord must retain a tension to thereby secure greeting cards such as shown at 84 in FIG. 4. An inextensible endless loop cord of sufficient length to pass over the legs 34 or 78 for installation on tube 28 or 58, respectively, would not then retain any such tension to secure the cards.

Of course, the specified endless loop elastic cords 32 and 80 may be conventional rubber bands, preferably colored rubber bands to provide a decorative accent to complement the seasonal or occasion theme for which the apparatus is being used, consistent with the decorative figurine 74 selected for use.

According to the above description I have invented a novel and improved greeting card display apparatus. Although I have described certain presently preferred embodiments of the invention hereinabove in order to comply with all applicable disclosure requirements pertaining to patent applications, I have of course contemplated various alternative and modified embodiments which would certainly also occur to others once they were apprised of my invention. Accordingly, it is my intention that the invention should be construed broadly and limited only by the scope of the claims appended hereto.

I claim:

1. A greeting card display apparatus or the like comprising:

an elongated, upstanding member having a pair of opposed axial ends and an axially elongated exterior periphery extending intermediate said opposed axial ends;

a plurality of opening means formed in each of said opposed axial ends with ones of said opening means adjacent one of said axial ends being disposed essentially in axial alignment with respective ones of said opening means adjacent the other of said axial ends;

card retention means retained by at least some of said opening means and adapted to retain greeting cards with respect to said display apparatus;

a pair of end cap means retained with respect to said upstanding member adjacent said opposed axial ends, respectively; and each of said end cap means including pocket means for receiving and retaining said opposed axial ends, respectively, in a manner that said end cap means axially overlap and conceal said pluralities of opening means, respectively.

2. The apparatus as set forth in claim 1 wherein at least one of said end cap means includes an axially elongated skirt portion forming said pocket means, said skirt portion having an axial extent sufficient to axially overlap the respective said plurality of opening means for concealment thereof when the respective one of said axial ends of said upstanding member is received in said pocket means of said one end cap.

3. The apparatus as set forth in claim 2 wherein said at least one of said end cap means is both of said end cap means.

4. The apparatus as set forth in claim 3 wherein said end cap means are essentially identical end caps.

5. The apparatus as set forth in claim 1 wherein said end cap means are essentially identical end caps.

6. The apparatus as set forth in claim 1 additionally including a base means and a rotary interface means disposed to support axial rotation of said upstanding member with respect to said base means.

7. The apparatus as set forth in claim 6 wherein said rotary interface means includes mutually engagable thrust bearing surface portions of said base means and a respective one of said end cap means.

8. The apparatus as set forth in claim 1 wherein one of said end cap means includes means for receiving and retaining a thematic motif.

9. The apparatus as set forth in claim 7 wherein the other of said end cap means includes means for receiving and retaining a thematic motif.

10. The apparatus as set forth in claim 1 wherein at least some of said opening means openings include axially open-ended slot means and intervening, axially extending leg means intermediate each adjacent pair of said slot means.

11. The apparatus as set forth in claim 10 wherein said card retention means includes a plurality of endless-loop elastic cord means received over mutually aligned pairs of said leg means at opposed ends of said upstanding member in a manner that two runs of each said cord means extend in tension axially between said mutually aligned pairs of said leg means, respectively.

12. The apparatus as set forth claim 1 wherein at least some of said cord retaining openings include aperture means opening through a side wall portion of said upstanding member and a cord retaining tongue means projecting axially within each said aperture means.

13. The apparatus as set forth in claim 12 wherein said card retention means includes a plurality of endless loop elastic cord means received over mutually aligned pairs of said tongue means at opposed ends of said upstanding member in a manner that two runs of each said cord means extend in tension axially between said mutually aligned pairs of said tongue means, respectively.

14. The apparatus as set forth in claim 1 wherein said card retention means includes a plurality of endless loop elastic cord means received and retained by mutually aligned pairs of said opening means at opposed ends of said upstanding member in a manner that two runs of each said cord means extend in tension axially between said mutually aligned pairs of said opening means, respectively.

15. The apparatus as set forth in claim 8 including a thematic motif which is interchangeably received and retained by said end cap means.

16. A greeting card display apparatus or the like comprising:

an elongated, upstanding member having a pair of opposed axial ends and an axially elongated exterior periphery extending intermediate said axial ends;

a plurality of opening means formed adjacent at least one of said axial ends;

said opening means being adapted to receive and retain a card retention means adjacent said exterior periphery of said upstanding means;

an end cap means retained with respect to said upstanding member adjacent said at least one of said axial ends;

said end cap means including pocket means for receiving and retaining said at least one of said axial ends in a manner that said end cap means axially overlaps and conceals said plurality of opening means;

said end cap means further including means for receiving and retaining a thematic motif; and a thematic motif interchangeably received and retained by said end cap means.

17. The apparatus as set forth in claim 16 wherein said end cap means includes an axially elongated skirt portion forming said pocket means, said skirt portion having an axial extent sufficient to axially overlap said plurality of opening means for concealment thereof when said at least one of said axial ends is received in said pocket means.

18. The apparatus as set forth in claim 16 additionally including a base means and a rotary interface disposed to support axial rotation of said upstanding member with respect to said base means.

* * * * *